United States Patent [19]

Zawacki, Jr. et al.

[11] 4,166,707

[45] Sep. 4, 1979

[54] SWIVEL LIPSTICK OR THE LIKE CONTAINER

[75] Inventors: John S. Zawacki, Jr., Meriden; Eric A. Hultgren, Westport, both of Conn.

[73] Assignee: Eyelet Specialty Co., Inc., Wallingford, Conn.

[21] Appl. No.: 845,038

[22] Filed: Oct. 25, 1977

[51] Int. Cl.[2] ..... A45D 40/04

[52] U.S. Cl. ..... 401/68; 401/78

[58] Field of Search ..... 401/62, 68, 71, 77, 401/78, 116

[56] References Cited

U.S. PATENT DOCUMENTS

| | | | |
|---|---|---|---|
| 2,088,899 | 8/1937 | Chevrego | 401/62 |
| 2,250,876 | 7/1941 | Mitchell | 401/68 X |
| 2,409,658 | 10/1946 | Book | 401/77 |
| 2,913,103 | 11/1959 | Isele | 401/78 |
| 2,999,585 | 9/1961 | Huttgren | 401/77 X |
| 3,335,853 | 8/1967 | Geisel | 401/68 |
| 3,814,524 | 6/1974 | Sperti | 401/62 X |

FOREIGN PATENT DOCUMENTS

| | | | |
|---|---|---|---|
| 1162533 | 9/1958 | France | 401/71 |

*Primary Examiner*—Edward M. Coven

*Attorney, Agent, or Firm*—Hopgood, Calimafde, Kalil, Blaustein & Lieberman

[57] ABSTRACT

The invention contemplates a special-purpose lipstick or the like container of the propel-repel swivel variety wherein an unused charge of cosmetic substance, such as a lipstick pomade, (a) is necessarily positioned and retained in a sufficiently elevated position for display purposes prior to purchase and prior to any initial use, (b) is propellable by a first cam system from the display position to a position of maximum pomade projection upon first actuation, (c) is then automatically transferable from the first to a second cam system, and (d) is thereafter actuable only via the second cam system to provide selective propel-repel swivel-lipstick action over an extended propulsion range, said extended range including retraction to a full extent which is below the elevated display position.

9 Claims, 3 Drawing Figures

SWIVEL LIPSTICK OR THE LIKE CONTAINER

The invention relates to a swivel lipstick or the like container of the variety in which coacting cams on relatively rotatable inner and outer tubular members determine the longitudinally projected or retracted position of a cam-following pomade carrier, in accordance with the direction and extent of the relative rotation of the tubular members.

It has been a problem in the retailing of lipstick or the like containers to enable the customer to select a desired one from a variety of pomade shades and textures while also assuring that the thus-inspected but not purchased article shall remain fresh and uncontaminated, thus enabling subsequent non-contaminating inspection by others on one or more occasions until ultimate purchase. To meet this problem, it has been proposed to employ a transparent removable closure cap through which color and texture are inspectable, and to limit the range of carrier propelling cam action, the range being of such limited retraction capability as to be insufficient to bring an unused pomade fully within the container. This fact necessarily means that every placement and removal of the closure cap is an invitation to contact the pomade with the bore of the closure cap, so that the cap soon becomes unsightly, and pomade is spread onto outer cap-receiving surfaces of the container.

It is an object of the present invention to provide an improved container of the character indicated, wherein the above-noted unsightly spreading of pomade can be assuredly avoided.

A specific object is to provide such a container with two cam systems, of different effective longitudinal propulsion capability, the shorter of these systems serving only the initial purposes of pomade display, and the longer of these systems serving only the subsequent conventional user purposes of selective pomade projection and retraction, to a retracted position below the display position.

Another specific object is to achieve the above objects with automatic transfer from the shorter to the longer of the cam systems, all in the course of initial relative rotation of the tubular members of the container.

A further object is to achieve the above objects in such manner that, once transfer has been effected to the longer cam system, the propel-repel action of the container shall be smooth and continuous over the full longitudinal range of actuation, above and below the partially elevated longitudinal position at which the pomade was initially positioned (by the shorter cam system) for display purposes.

It is also an object to meet the above objects utilizing the same cam and cam-follower means to a maximum extent.

Still another object is to meet the above objects (a) without adding to the number of parts needed for a conventional swivel container and (b) with least modification of such parts.

A general object is to achieve the above objects at minimum cost and complexity.

Other objects and various further features of novelty and invention will be pointed out or will occur to those skilled in the art from a reading of the following specification, in conjunction with the accompanying drawings. In said drawings, which show, for illustrative purposes only, a preferred form of the invention:

FIG. 3 is an enlarged fragmentary schematic flattened developmental view of inner and outer cam system profiles for the container of FIG. 1, these profiles being presented in side-by-side relation and to the same scale of degrees about the central axis of the container.

Figure 5:
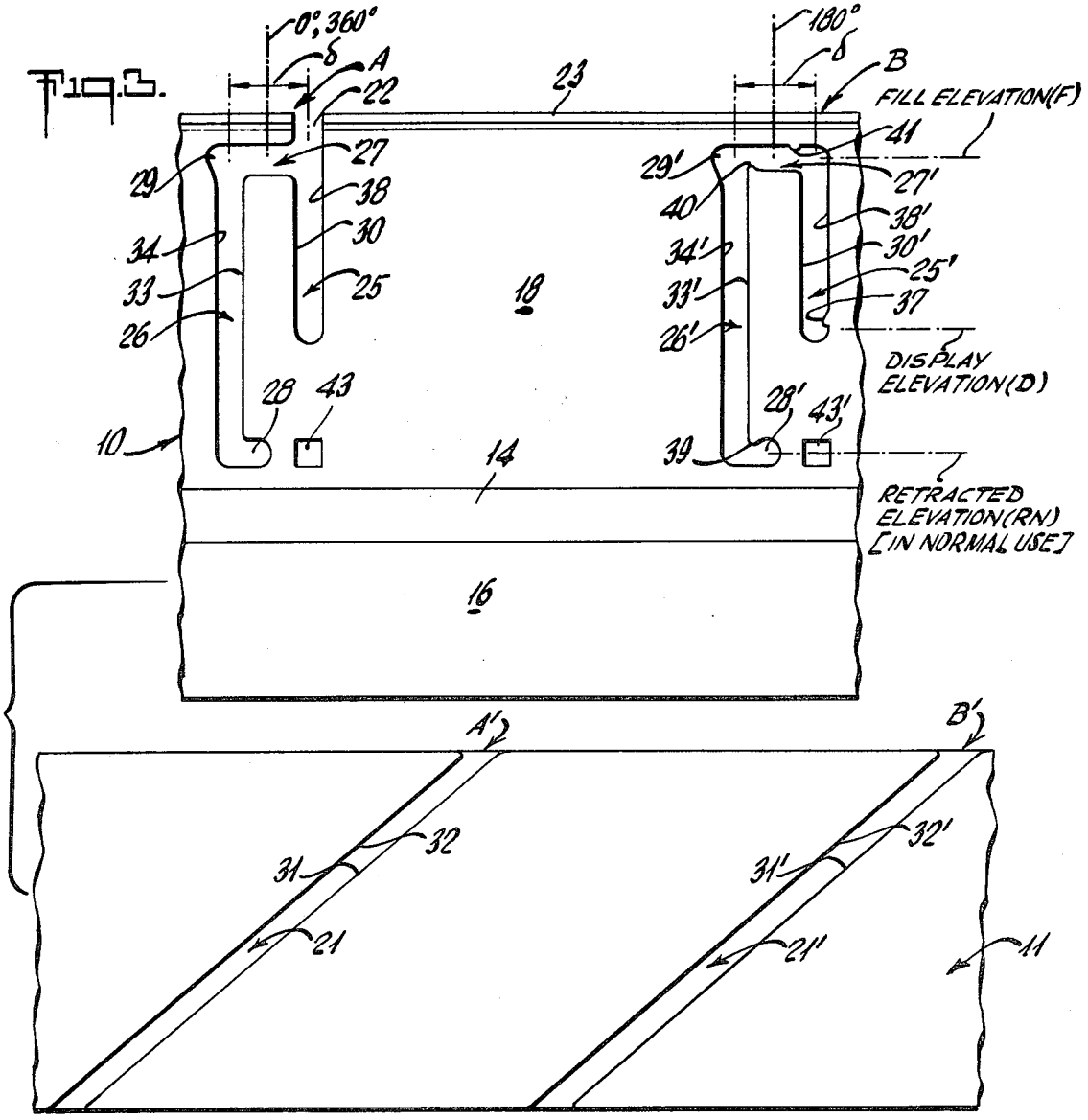

In the drawings, the invention is shown in application to a swivel lipstick container comprising relatively rotatable inner and outer tubular members 10–11 equipped to support and selectively propel and retract a lipstick pomade 12 through and beyond the upper open end of members 10–11. A closure cap 13 is fitted to and frictionally retained at a land 14 and against the adjacent shoulder 15 of the base operating end 16 of the inner tubular member 10. The closure cap is transparent, as of suitable injection-molded plastic, and has an internal cavity which clears the pomade 12 when in the partially extended display position shown in FIG. 1. The rounded internal contour of the closed end of cap 13, in conjunction with the more flattened external contour of the same end will be understood to provide an optical effect for enhancement of the displayed end of pomade 12. Prior to use, the pomade 12 is retained in the display position of FIG. 1, and a rupturable circumferential seal (not shown) of plastic tape or the like in longitudinal overlap with adjacent exposed regions of cap 13 and base 16 assures that the container cannot be operated unless and until the seal is ruptured.

Figure 2:
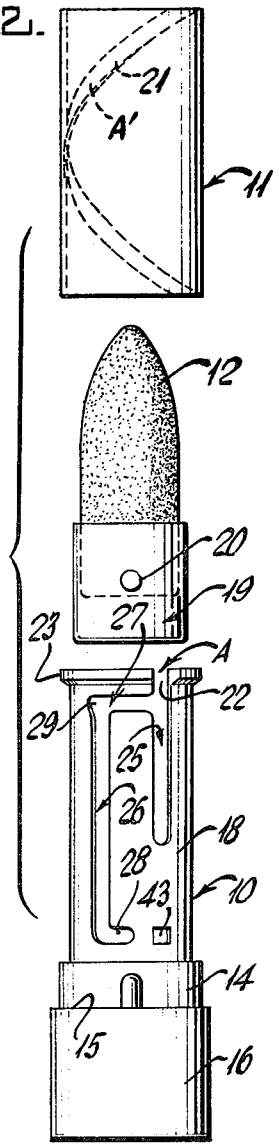
FIG. 2 is an exploded view in elevation of propulsion parts of the container of FIG. 1.

As best seen in FIG. 2, the inner tubular member 10 comprises a tubular shell portion 18 which extends upwardly from the base portion 16 and land portion 14; this inner-shell portion 18 is equipped with "straight" or longitudinal cam means in the form of slots to be later described. The pomade 12 is mounted in an upwardly open carrier-cup member 19 having a cylindrical outer surface that is guided by the cylindrical bore of the inner-shell portion 18, and cam-follower means 20 of carrier cup 19 projects radially for coaction with the cam means of both inner and outer members 10–11. The outer tubular member 11 may be an assembly of an outer shell to a spiral-slotted sleeve, but in the form shown member 11 is a single injection-molded plastic part, having a smooth cylindrical exterior and a spirally grooved cylindrical bore, the spiral groove formation 21 being part of the cam system and also receiving the cam follower 20. Preferably, the indicated cam system is provided essentially in duplicate, at 180-degree spacing about the container axis, with two diametrically opposed cam followers 20 on carrier 19, so that propulsion and retraction thrusts can be symmetrically developed with respect to the container axis.

In accordance with the invention, the described parts are equipped with two cam systems, a shorter cam system serving only for initial display purposes, i.e., prior to purchase and first use, and a longer cam system which thereafter serves for the useful life of the container. In the form shown, the described conventional construction of the outer tubular member 11 and of the carrier 19 serves the purposes of the invention and therefore requires no modification, and reliance is placed on special construction of the inner-shell portion 18 to achieve the shorter-cam and longer-cam feature indicated. At the same time, the desirable 180-degree symmetry of propulsion action is retained.

Achievement of the foregoing is best understood from FIG. 3, wherein essentially duplicate "straight" cam systems A and B are provided at 180-degree spacings in inner shell 18, for cam-follower coaction with corresponding spiral cam grooves 21–21' at regions A'–B' of outer tubular member 11. The cam-slot system A extends at 22 to the upper end of inner shell 18 to permit transient compliant circumferential reduction of the open end of shell 18 in the course of assembly of the parts, thus enabling a circumferential bead 23 to be assembled via the bore of outer tubular member 11 and to thereafter retain such assembly with freedom for relative rotation of members 10–11.

Each of the "straight" cam systems A and B of inner shell 18 comprises a shorter cam slot 25 (25') and a longer cam slot 26 (26'), at identical angular offsets δ with respect to each other, the width of these slot formations being preferably in smooth guiding clearance with the effective diameter of the associated cam-follower element 20. And for each of these systems (A–B) an offsetting slot formation 27 (27') provides bridged communication between the shorter and longer cam slots 25 (25') and 26 (26'), such communication being shown at the upper ends of the "straight" cam slots 25 (25') and 26(26'). Thus, as long as the cam followers 20 are tracking the spiral cams 21 (21') and the shorter "straight" cams 25 (25'), carrier retraction is limited by the lower ends of cams 25 (25'); this "retracted" condition will be understood to account for the moderately elevated pomade-display condition depicted in FIG. 1. On the other hand, as long as cam follower 20 are tracking the spiral cams 21 (21') and the longer "straight" cams 26 (26'), carrier retraction is determined by the lower ends of cams 26 (26'); this "retracted" condition will be understood to account for full or substantially full retraction of pomade 12 within the inner and outer tubular members, thus avoiding or substantially reducing the chance of pomade contact with the cap 13 upon or after each use of the container. Legends at D and at RN in FIG. 3 respectively identify the "display elevation" and the elevation associated with such retraction in normal use of the container.

Further slot formations in common with systems A and B of inner shell 18 include a lateral offset 28 (28') at the lower end of the longer slots 26 (26') and extending in the direction of offset of the associated shorter slot 25 (25'). Additionally, a small lateral-offset portion 29 (29') extends in the opposite lateral direction at the upper end of the longer slots 26 (26').

Figure 1:
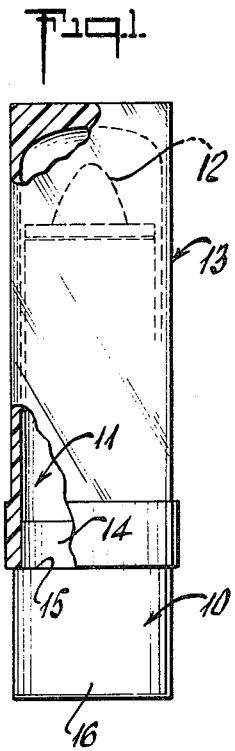
FIG. 1 is a partly broken-away view in elevation of a container of the invention, in its condition of closure and sealing, suitable for display to one or more prospective purchasers.

As thus far described, the slot systems A and B of the inner shell 18, in cam-follower coaction with the 180-degree separated cam-system regions A'–B' of the outer tubular member, are capable of establishing the following sequence of operating events, commencing with the display situation depicted in FIG. 1:

a. Commencing with the cam-follower means at display elevation D (i.e., at the bottom end of the shorter cam slots 25–25'), clockwise rotation of base 16 and hence inner shell 18 (to the right in the sense of FIG. 3), relative to the outer tubular member 11, brings the left edges 30–30' of slots 25–25' and the lower edges 31–31' of spiral cams 21–21' into longitudinally upward driving relation with their associated cam followers 20, resulting in upward projecting advance of pomade 12 beyond the display position depicted in FIG. 1.

b. With continued clockwise rotation, pomade advance reaches a maximum at the elevation F, designated "Fill Elevation" for a purpose which will later be explained. Longitudinal advance beyond this elevation is precluded by the finite upper end of the slot 25'.

c. With continued clockwise rotation, the left edges 30–30' are no longer present, and the cam followers enter their offset-communication slots 27–27', keeping the pomade carrier at the maximum follower elevation F, until all such clockwise rotation is brought to a halt by follower abutment with small offset 29–29' forming corresponding parts of the longer cam system 26 (26'). It goes without saying that in the projected position determined by follower elevation F, the pomade 12 can have first cosmetic-application use.

d. Having thus first used the pomade, it is retracted by counterclockwise relative rotation of members 10–11, meaning, in the sense of FIG. 3, a leftward displacement of "straight" cam systems A–B with respect to spiral cam systems A'–B'. Such counterclockwise rotation brings the upper edges 32 (32') of the spiral cams 21 (21') and the right-hand edges 33 (33') of the longer cams 26 (26') into longitudinally downward driving relation with their associated cam followers, resulting in retracting displacement of pomade 12 into the included volume of members 10–11.

e. With continued counterclockwise relative rotation, pomade retraction continues until the cam followers reach the full retraction elevation RN, at the bottom end of the longer slots 26 (26'). At this location, the right-hand edges 33 (33') have terminated and the offsets 28 (28') are available to receive the cam followers, thus establishing a lock-retention of the pomade-retracted position. The closure cap 13 may then be applied, with minimum chance of contacting pomade, for storage of the container until its next use.

f. For the next and for each succeeding use of the container, and after removal of the closure cap 13, the members 10–11 are subjected to clockwise relative rotation, meaning, in the sense of FIG. 3, a rightward displacement of cam means A–B with respect to cam means A'–B'. Such clockwise rotation brings the left edges 34 (34') of the longer cam slots 26 (26') and the lower edges 31 (31') of the spiral cams 21 (21') into upward driving relation with their associated cam followers, resulting in projection of pomade 12 for use. Such projection can be to the extent desired for use, and the limit of such projection is determined by the follower level F, at which point the followers have again entered the upper offsets 29 (29') of the longer cam slots 26 (26').

g. Retraction for storage until the next use proceeds from subsequent counterclockwise relative rotation of members 10–11, exactly as explained under d and e above.

Having thus explained an overall succession of events, occurring solely upon the indicated extent and direction of relative rotation of members 10–11, certain further features will now be identified, involving resilient detent action to retain certain relative positions of the parts, as follows:

1. To retain the display position, a detent projection 37 characterizes the lower end region of the right-hand edge 38' of the shorter slot 25'. Detent means 37 will be understood to locally narrow the slot 25' for compliantly yieldable interference with the associated cam follower 20, so that snap action past detent 37 is necessary to bring the cam follower into the display elevation D in the first place, and so that similar snap action past detent 37 is necessary to advance the cam follower upwardly from the display elevation D.

2. To retain the retracted elevation RN, a similar detent projection 39 characterizes the upper edge of offset slot 28', at juncture with the right-hand edge 33' of slot 26'. Detent means 39 will be understood to locally narrow the entrance to slot 28' for compliantly yieldable interference with the associated cam follower 20, so that snap action past detent 39 is necessary to "lock" said cam follower in its fully retracted position within offset 28', and so that similar snap action past detent 39 is necessary to bring the cam followers into position for upward advance of the pomade carrier.

3. To retain the "Fill Elevation (F)", a first detent projection 40 in the lower edge of the communication slot 27' and a second detent projection 41 in the upper edge of slot 27' respectively define laterally spaced left and right retaining limits for the associated cam follower. Thus, snap action at detent 41 characterizes cam-follower passage from slot 25' to slot 27', and snap action at detent 40 characterizes cam-follower passage from slot 27' to slot 26'.

It is a feature of the invention that the laterally offset detent means 40–41 shall initially position the container parts, with an unloaded carrier 19 at its most-elevated position F. This is the way the container manufacturer makes the article for shipment to his customer, the cosmetic-filling (pomade supplying) house. In this detent-retained position at elevation F, the upper edge or skirt of the carrier cup 19 preferably extends a short distance beyond the upper end of the outer tubular member 11, so that automated pomade-assembly apparatus may have concentric registering or locating contact with cup 19 (to the exclusion of member 11) for clean pomade-loading of the carrier 19, thus assuring no pomade contact with member 11. Once the pomade has been loaded at the detent-retained fill elevation F, the cosmetic-filling house performs a single counterclockwise relative rotation of members 10–11, meaning, in the sense of FIG. 3, a leftward displacement of cam means A–B with respect to cam means A'–B'. Such leftward displacement displaces the cam followers past the detent 41 and into registry with the shorter cam slots 25 (25') so that continued counterclockwise rotation brings the right-hand edges 38–38' of "straight" slots 25 (25') and the upper edges 32 (32') of spiral cams 21 (21') into downwardly displacing coaction with the associated cam followers, it being understood that such downward displacement is continued until detent retention (at 37) of the display elevation D. The closure cap and seal are then applied by the cosmetic-fill house to complete the assembly.

It will be understood that we have described improved cosmetic container means meeting all stated objects and providing as simple and foolproof a mechanism as if the display-elevation feature had not been present. The invention lends itself to all-metal or to all-plastic construction, and to constructions in which the parts are of different materials. In the event that the inner member 10 with its shell 18, is of injection-molded plastic, the various described slot regions and their 180-degree displaced symmetry provide an ideal geometry for radial stabilization of the core piece by which the cylindrical bore of shell 18 is defined; total symmetry of core piece support is afforded by additional radial-positioning members (not shown) which account for the otherwise non-functional square openings 43 (43') at projected intersection of the longitudinal and lateral-offset alignments of slots 25 (25') and 28 (28') respectively.

While the invention has been described in detail for the preferred form shown, it will be understood that modifications may be made without departure from the claimed scope of the invention.

What is claimed is:

1. A swivel container for lipstick or the like, comprising concentric inner and outer relatively rotatable tubular members which are open at the same end, a carrier including cam-follower means and slidably guided within said inner member, cam means on said tubular members and coacting with said cam-follower means for selective longitudinal displacement of said carrier means upon relative rotation of said tubular members, said inner-member cam meams comprising first and second longitudinally extending slots at angularly spaced locations, one of said slots being of length to accommodate a maximum range of ultimate carrier-propulsion use and the other of said slots being of lesser length, said inner-member cam means including means defining an offset-slot communication of said other slot with said one slot near the upper end of said one slot; whereby, when said cam-follower means is in said other slot, the bottom end of said other slot may establish the retracted elevation of said carrier member at a level above the retracted elevation established when said cam-follower means is in said one slot; the retracted elevation in said one slot being sufficiently low to fully retract an unused lipstick or the like carrier by said carrier means, and the retracted elevation in said other slot being such as to externally expose the outer end of such unused lipstick or the like for visual display of the color and texture of the lipstick or the like without requiring container actuation.

2. The container of claim 1, said outer-member cam means including a spiral course for substantially the longitudinal extent of said one slot and being characterized by one spiral edge to engage said cam-follower means in the course of carrier propulsion and by a second spiral edge to engage said cam-follower means in the course of carrier retraction, the direction of offset-slot communication between said one and said other slot being such that said one spiral edge is relied upon to actuate said cam-follower means in transfer from said other to said one slot, whereby upon first propulsion use of a container loaded with such externally exposed lipstick or the like, said cam-follower means is automatically transferred from said other to said one slot, so that thereafter all recycled propulsions cycles of said container will rely upon said one slot, for maximum available propulsion range.

3. The container of claim 1, in which said means defining an offset-slot communication includes compliantly deformable detent means coacting with said cam-follower means for retaining said carrier means in raised position, whereby carrier-loading with lipstick or the like material may be facilitated.

4. The container of claim 1, in which said inner member includes compliantly deformable detent means coacting with said cam-follower means at the lower-end region of said other slot for detent-retention of said carrier means at said lower-end region.

5. The container of claim 1, in which said inner member includes compliantly deformable detent means coacting with said cam-follower means and at the lower end of said one slot for detent-retention of said carrier means at said lower end.

6. The container of claim 5, in which the lower end of said slot is characterized by a laterally-offset portion extending in the direction of said other slot, and in which said detent means is in said laterally-offset portion.

7. The container of claim 1, in which said inner member cam means is one of two like sets of angularly spaced first and second longitudinally extending slots with corresponding offset-slot communication therebetween, corresponding parts of said sets being at diametrically opposite locations, said outer tubular member cam means and said cam-follower means being also effectively in duplicate and at diametrically opposite locations.

8. The container of claim 7, in which the upper end of said inner tubular member is peripherally discontinuous at a slot opening that is longitudinally aligned with said other cam slot of one to the exclusion of the other of said sets.

9. The container of claim 8, in which said inner tubular member includes compliantly deformable detent means coacting with said cam-follower means for retaining said carrier means in a selected longitudinal position, said detent means comprising a local cam-slot edge contour having transient resilient interference with passage of the associated cam-follower means, said detent means being formed in a cam slot of said other set to the exclusion of said one set.

* * * * *